US008181722B2

(12) United States Patent
Radford et al.

(10) Patent No.: US 8,181,722 B2
(45) Date of Patent: May 22, 2012

(54) STABILIZER ASSEMBLIES WITH BEARING PAD LOCKING STRUCTURES AND TOOLS INCORPORATING SAME

(75) Inventors: Steven R. Radford, The Woodlands, TX (US); Kevin G. Kidder, Carencro, LA (US); Khoi Q. Trinh, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 317 days.

(21) Appl. No.: 12/557,150

(22) Filed: Sep. 10, 2009

(65) Prior Publication Data

US 2010/0212970 A1 Aug. 26, 2010

Related U.S. Application Data

(63) Continuation-in-part of application No. 12/389,920, filed on Feb. 20, 2009, now Pat. No. 8,074,747.

(51) Int. Cl.
*E21B 17/10* (2006.01)

(52) U.S. Cl. ..... 175/325.7; 166/241.7

(58) Field of Classification Search ..... 175/325.7
See application file for complete search history.

(56) References Cited

U.S. PATENT DOCUMENTS

| | | | | |
|---|---|---|---|---|
| 1,940,415 | A | 12/1932 | Harrington et al. | |
| 2,096,447 | A | 10/1937 | Catland | |
| 2,566,573 | A | 9/1951 | Lyon | |
| 2,901,787 | A | 9/1959 | Whistler et al. | |
| 2,973,996 | A | 3/1961 | Self | |
| 3,054,466 | A | 9/1962 | Wagnon et al. | |
| 3,618,992 | A | 11/1971 | Whistler et al. | |
| 3,680,647 | A | 8/1972 | Dixon et al. | |
| 4,443,130 | A | 4/1984 | Hall | |
| 4,508,184 | A | 4/1985 | Hansen | |
| 4,674,576 | A | 6/1987 | Goris et al. | |
| 4,792,000 | A | 12/1988 | Perkin et al. | |
| 5,134,285 | A | 7/1992 | Perry et al. | |
| 5,363,931 | A | 11/1994 | Moriarty | |
| 5,421,626 | A | 6/1995 | Glachet | |
| 5,447,207 | A | 9/1995 | Jones | |
| 5,642,960 | A | 7/1997 | Salice | |
| 5,778,976 | A | 7/1998 | Murray | |
| 5,810,100 | A | 9/1998 | Samford | |
| 5,868,212 | A | 2/1999 | McManus | |
| 6,360,831 | B1 * | 3/2002 | Akesson et al. | 175/269 |
| 7,000,713 | B2 | 2/2006 | Crooks | |
| 7,036,611 | B2 | 5/2006 | Radford et al. | |
| 7,124,818 | B2 | 10/2006 | Berg et al. | |
| 7,308,937 | B2 | 12/2007 | Radford et al. | |
| 7,549,485 | B2 | 6/2009 | Radford et al. | |

(Continued)

OTHER PUBLICATIONS

International Written Opinion for International Application No. PCT/US2010/024688 mailed Aug. 23, 2010, 3 pages.

(Continued)

*Primary Examiner* — Jennifer H Gay
(74) *Attorney, Agent, or Firm* — TraskBritt

(57) ABSTRACT

Stabilizer assemblies and tools incorporating same are disclosed. In one embodiment, a stabilizer assembly comprises a body having at least one bearing pad receptacle therein, and a bearing pad disposed in the receptacle. The bearing pad includes at least a portion of a bore extending therethrough, the bore being aligned with body bores in the body on opposite sides of the bearing pad receptacle. A lock rod extends through the bore and into the associated body bore.

14 Claims, 8 Drawing Sheets

U.S. PATENT DOCUMENTS

| | | | | |
|---|---|---|---|---|
| 7,621,344 | B2 | 11/2009 | Frey | |
| 7,681,666 | B2 * | 3/2010 | Radford et al. | 175/267 |
| 8,074,747 | B2 * | 12/2011 | Radford et al. | 175/325.7 |
| 2005/0145417 | A1 * | 7/2005 | Radford et al. | 175/57 |
| 2008/0105464 | A1 | 5/2008 | Radford | |
| 2008/0105465 | A1 | 5/2008 | Radford et al. | |
| 2008/0110678 | A1 | 5/2008 | Radford et al. | |
| 2008/0128174 | A1 | 6/2008 | Radford et al. | |
| 2008/0128175 | A1 | 6/2008 | Radford et al. | |
| 2010/0212969 | A1 | 8/2010 | Radford et al. | |

OTHER PUBLICATIONS

International Search Report for International Application No. PCT/US2010/024688 mailed Aug. 23, 2010, 2 pages.

Radford, Steven, et al., "Novel Concentric Expandable Stabilizer Results in Increased Penetration Rates and Drilling Efficiency with Reduced Vibration," SPE/IADC 119534, Copyright 2009, SPE/IADC Drilling Conference and Exhibition, Amsterdam, The Netherlands, Mar. 17-19, 2009, pp. 1-13.

* cited by examiner

STABILIZER ASSEMBLIES WITH BEARING PAD LOCKING STRUCTURES AND TOOLS INCORPORATING SAME

CROSS-REFERENCE TO RELATED APPLICATION

This application is a continuation-in-part of U.S. patent application Ser. No. 12/389,920, filed Feb. 20, 2009, now U.S. Pat. No. 8,074,747, issued Dec. 13, 2011, the disclosure of which is incorporated by reference herein in its entirety.

TECHNICAL FIELD

Embodiments of the present invention relate generally to downhole tools for use in subterranean well bores and, more specifically, to stabilizer assemblies including locking structures for replaceable stabilizer pads used therein as well as to tools incorporating such stabilizer assemblies.

BACKGROUND

Stabilizer assemblies are often used in downhole assemblies, either to center the assembly secured to a drill string in a well bore (so-called "concentric" stabilizer assemblies) or to move or hold the downhole assembly in position away from a central axis of the well bore (so-called "eccentric" stabilizer assemblies). The former type of stabilizer assemblies are conventionally employed in vertical, directional and horizontal drilling, including reaming of a well bore previously drilled or drilled by a pilot bit at a distal end of the drill string below a reamer. If employed with a downhole assembly for reaming a well bore, the stabilizer assembly may comprise a radially expandable stabilizer or a fixed stabilizer assembly, either of which may comprise a part of a reaming tool or be run in conjunction with the reaming tool on the drill string. The latter type of stabilizer assemblies are generally used, in conjunction with a downhole motor, in directional drilling to orient the downhole assembly for drilling in a selected direction. As with concentric stabilizer assemblies, eccentric stabilizer assemblies may be either laterally expandable or fixed.

In either instance, stabilizer assemblies employ bearing structures, sometimes referred to as bearing pads, having radially outwardly facing bearing surfaces for contacting the wall of a well bore in which the stabilizer assembly is disposed. While such radially outwardly facing bearing surfaces may include abrasion-resistant materials thereon, such as metallic hardfacing, tungsten carbide inserts, diamond or other superabrasive material or other wear elements, rotation and longitudinal movement of the drill string during a drilling operation in the presence of solids-laden drilling fluid or mud in the well bore between the radially outwardly facing bearing surfaces eventually results in sufficient wear, if not damage, to require refurbishment of these surfaces to avoid irreparable damage to the stabilizer assembly.

One approach to refurbishment has been to simply apply new hardfacing to the bearing surfaces. However, such an approach is unwieldy as it requires manipulation of an entire stabilizer assembly, requires skilled application of the hardfacing material, and the bearing surface may have to be reground after the hardfacing is applied to bring the stabilizer assembly diameter into a desired specification. In addition, and more critical to tool durability and longevity, is the creation by application of hardfacing to the steel tool body of a heat affected zone (HAZ) in the steel, which HAZ leads to stress crack propagation.

Another approach to bearing surface refurbishment, which Applicants do not admit is prior art to the present invention, is to structure bearing pads as removable and replaceable elements secured within bearing pad receptacles of a body of the stabilizer assembly, or other down tools, and to secure the bearing pads using bolts extending transversely from one side of the bearing pad receptacle to the opposing side, through the bearing pads. Threads have been placed at the far (distal) end of a bolt to engage threads in a blind bore opposing a through bore into which the bolt is inserted to pass through the bearing pad. Threads have also been placed at the near (proximal) end of a bolt, to engage with threads in a through bore through which the bolt is inserted, after the inserted bolt is extended through the bearing pad and into an opposing, blind bore. Each of the foregoing approaches to securing a bolt in place, however, results in breakage of the bolts due to the presence of either or both of smaller diameter areas or high stress concentrations on the bolt or threads on the bolt adjacent high stress areas proximate the area between a side of a bearing pad and an adjacent side of the bearing pad receptacle in which the bearing pad resides. These high stress areas render the bolts susceptible to shear or vibration-induced, cyclical fatigue resulting from rotation of the stabilizer assembly during a drilling operation.

BRIEF SUMMARY

Embodiments of the present invention relate to locking structures for retaining replaceable bearing pads in a body of a stabilizer assembly, and to stabilizer assemblies incorporating such locking structures. Such locking structures may have particular applicability to fixed blade or pad stabilizer assemblies for use in conjunction with expandable reamers and stabilizers for enlarging well bores, but are not so limited.

In some embodiments, a stabilizer assembly or other downtool assembly comprises a body having at least one longitudinally extending bearing pad receptacle therein, and a bearing pad disposed in the receptacle. The bearing pad includes at least two bores extending therethrough, the bores being aligned with bores in the body on laterally opposite sides of the bearing pad receptacle. A lock rod extends through each bearing pad bore and into the associated body bores.

In further embodiments, the pad bores may be longitudinally separated and may extend transversely through the bearing pad.

In yet further embodiments, the pad bores may be laterally separated and may extend longitudinally through the bearing pad.

In additional embodiments, a body bore aligned with a bearing pad bore on one side of the bearing pad receptacle comprises a blind bore opening onto the bearing pad receptacle, while an aligned body bore on an opposite side of the bearing pad receptacle comprises a through bore extending from the bearing pad receptacle to an exterior surface of the body. The lock rod is of a length with one end thereof received substantially within the blind bore, the lock rod extending through an aligned bearing pad bore and an opposing end thereof extending into an adjacent portion of the opposing, through bore. The through bore has received therein a removable closure outboard of an end of the lock rod.

In yet additional embodiments, the aligned body bores on opposite sides of the bearing pad receptacles may each comprise an open bore, and a removable closure may be disposed in each open bore outboard of the end portions of the lock rod extending respectively thereinto.

In further embodiments, an end of a lock rod to be disposed in an open bore comprises an extraction structure configured for engagement by a tool to pull the lock rod from the bearing pad and body for removal of a worn or damaged bearing pad and replacement thereof.

In yet further embodiments, a biasing structure may be disposed within a blind bore for contacting the end of a lock rod received therein and resiliently biasing the lock rod outwardly from an aligned, open bore on the opposite side of a bearing pad receptacle.

In additional embodiments, dampening structures may be associated with the bearing pad for reducing any tendency for cyclical fatigue-induced failure of the lock rods.

In yet additional embodiments, a stabilizer assembly comprises a body having at least one longitudinally extending bearing pad receptacle therein and at least two body grooves formed in a sidewall of the bearing pad receptacle. A bearing pad disposed in the at least one bearing pad receptacle may include at least two pad grooves formed in a sidewall thereof complementary to the at least two body grooves. The at least two body grooves and the at least two pad grooves may form at least two bores. Each of the bores being formed by one of the at least two pad grooves and one of the at least two body grooves. The stabilizer assembly may further include a plurality of body bores on opposite sides of the at least one bearing pad receptacle. Each body bore may be aligned with a body bore on an opposite side of the at least one bearing pad receptacle and at least partially aligned with one of the at least two bores. A lock rod may extend through at least one bore of the at least two bores and into each body bore aligned therewith.

In further embodiments, the at least two body grooves and the at least two pad grooves may extend laterally along the bearing pad and the bearing pad receptacle.

In yet further embodiments, the at least two body grooves and the at least two pad grooves may extend longitudinally along the bearing pad and the bearing pad receptacle.

In additional embodiments, a stabilizer assembly comprises a body having at least one longitudinally extending bearing pad receptacle therein and a plurality of longitudinally extending body bores formed on each longitudinal side of the at least one bearing pad receptacle. A bearing pad may be disposed in the at least one bearing pad receptacle. At least two longitudinally extending bores may be formed in at least one of a portion of the bearing pad and a portion of the at least one bearing pad receptacle. Each of the bores may be longitudinally aligned with at least two body bores of the plurality of body bores. A lock rod may extend through each of the at least two bores and into at least one body bore of the plurality of body bores aligned therewith.

In yet additional embodiments, a downhole tool comprises a longitudinally extending body including a stabilizer portion having a plurality of circumferentially spaced bearing pad receptacles therein. At least one of the plurality of bearing pad receptacles includes a first wall on a longitudinal side of the bearing pad receptacle having at least two blind bores formed therein and a second wall on a longitudinally opposite side of the bearing pad receptacle having at least two through bores formed therein and extending therefrom to an exterior surface of the longitudinally extending body. A bearing pad may be disposed in each of the plurality of bearing pad receptacles. At least one of a portion of the bearing pads and a portion of the bearing pad receptacles form at least two longitudinally extending bores. Each bore may be aligned with at least one blind bore of the at least two blind bores and at least one through bore of the at least two through bores. Each of a plurality of lock rods may extend through at least one bore of the at least two longitudinally extending bores and into at least one blind bore of the at least two blind bores.

Other embodiments of the invention comprise downhole tools incorporating stabilizer assemblies according to the present invention.

DETAILED DESCRIPTION

Some of the illustrations presented herein are not meant to be actual views of any particular material or device, but are merely idealized representations that are employed to describe embodiments of the invention. Additionally, elements common between figures may retain the same numerical designation.

As used herein, the term "body," when applied to a stabilizer assembly, may comprise either a substantially tubular tool body, which may be directly connected to a drill string and through which drilling fluid may flow, or a frame having a bearing pad receptacle therein, the frame itself being movably disposed in a tool body for radial extension from the tool body responsive (by way of example only) to pressure of drilling fluid flowing therethrough. If the former, the substantially tubular tool body may comprise an expandable reamer tool body having radially extendable blades bearing cutting structures and a stabilizer assembly longitudinally spaced therefrom.

As used herein, the term "outboard" is with reference to a bearing pad receptacle, and an element or feature described as outboard of another element or feature is, thus, indicated as being farther away from the bearing pad receptacle.

Figure 1:
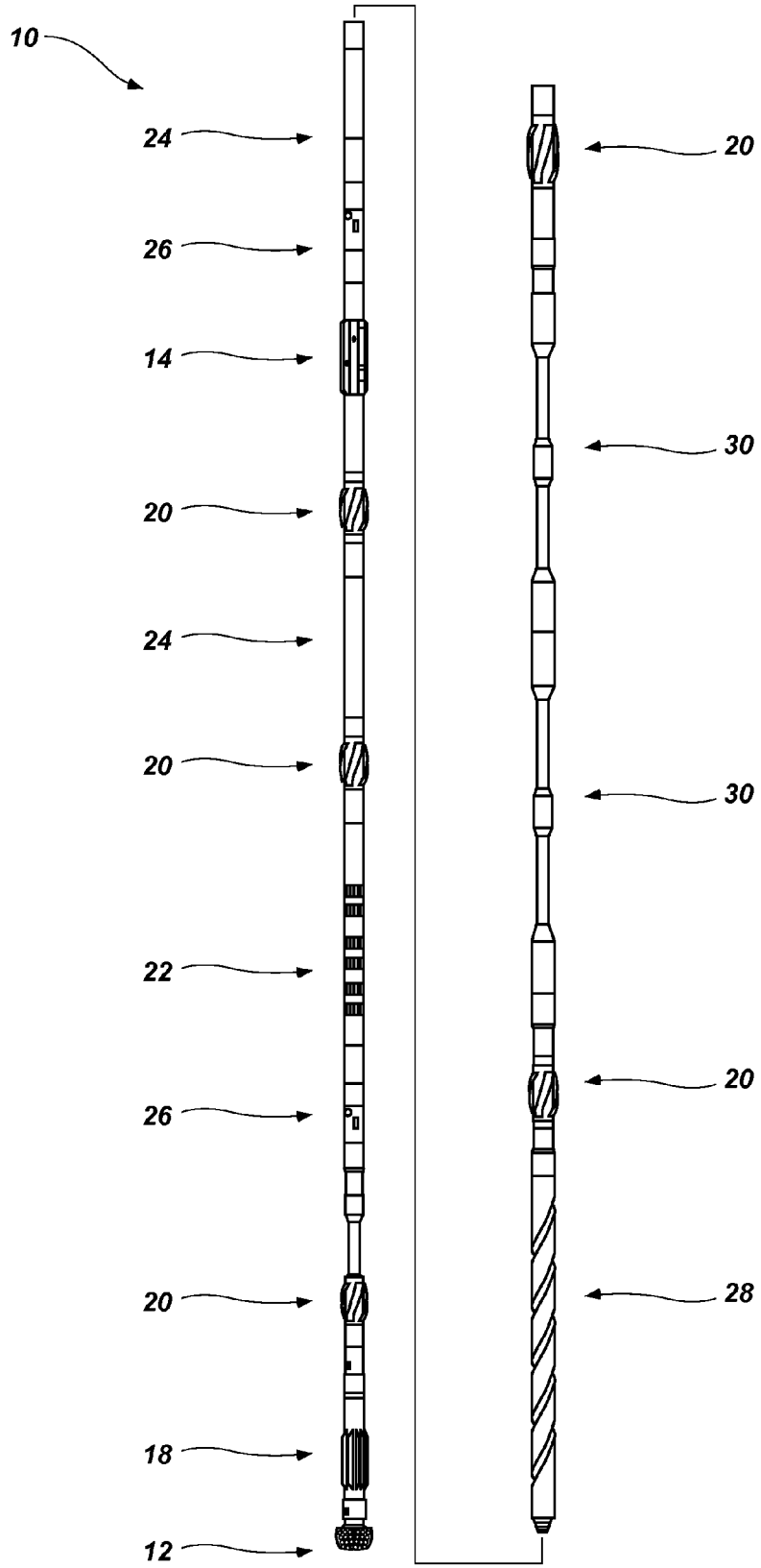
FIG. 1 is a schematic of a bottom hole assembly including an expandable reaming tool comprising a stabilizer assembly according to an embodiment of the invention.

Referring now to FIG. 1, a downhole assembly secured is illustrated. The downhole assembly may comprise a so-called "bottom hole assembly" 10 used for reaming a well to a larger diameter than that initially drilled, for concurrently drilling and reaming a well bore, or for drilling a well bore. However, the term "downhole assembly" is not so limited, and encompasses any tubular string, including a string of drill pipe as well as a coiled tubing string, having a stabilizer assembly incorporated therein. The bottom hole assembly 10, as illustrated, includes a pilot drill bit 12 and an expandable reaming tool 14. The bottom hole assembly 10 optionally may include various other types of drilling tools such as, for example, a steering unit 18, one or more stabilizers 20, a measurement while drilling (MWD) tool 22, one or more bi-directional communications pulse modules (BCPM) 24, one or more mechanics and dynamics tools 26, one or more drill collars 28, and one or more heavy weight drill pipe (HWDP) segments 30. The bottom hole assembly 10 may be rotated within a wellbore by, for example, rotating the drill string to which the bottom hole assembly 10 is attached from the surface of the formation, or a downhole hydraulic motor may be positioned above the bottom hole assembly 10 in the drill string and used to rotate the bottom hole assembly 10. By way of example and not limitation, some or all of expandable reaming tool 14 and stabilizers 20 may incorporate a stabilizer assembly according to an embodiment of the invention.

The expandable reaming tool 14 of the bottom hole assembly 10 may comprise, for example, a reaming tool as disclosed in at least one of U.S. Pat. No. 7,036,611 to Radford et al., U.S. Pat. No. 7,308,937 to Radford et al., U.S. Pat. No. 7,549,485 to Radford et al., U.S. Patent Application Publication No. US 2008/0128175 A1 by Radford et al., which published Jun. 5, 2008, and U.S. Patent Application Publication No. US 2008/0128174 A1 by Radford et al., which published Jun. 5, 2008, each of which is assigned to the assignee of the present invention and the disclosure of each of which is incorporated by reference herein in its entirety.

Figure 2:
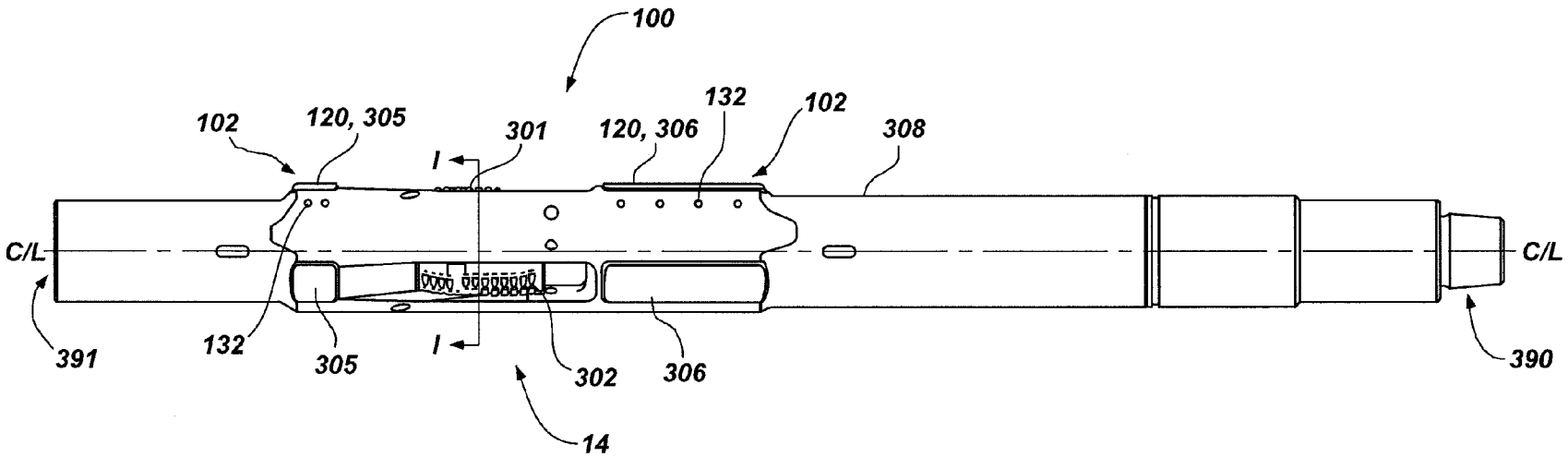
FIG. 2 is an enlarged, side elevational view of the expandable reaming tool in the bottom hole assembly of FIG. 1.
Figure 2A:
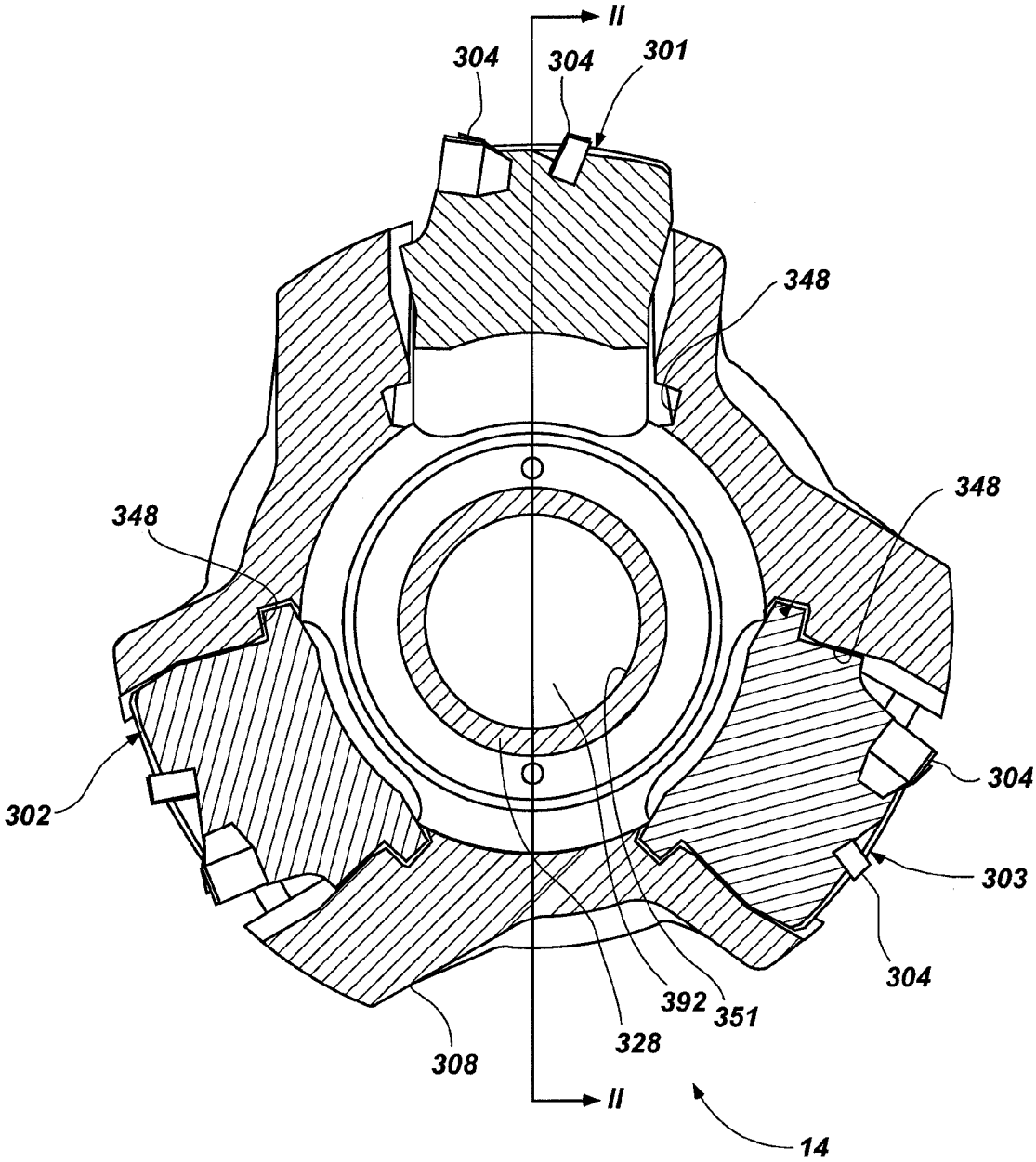
FIG. 2A is a transverse cross-sectional view and FIG. 2B is a longitudinal cross-sectional view of the expandable reaming tool of FIG. 2.
Figure 2B:
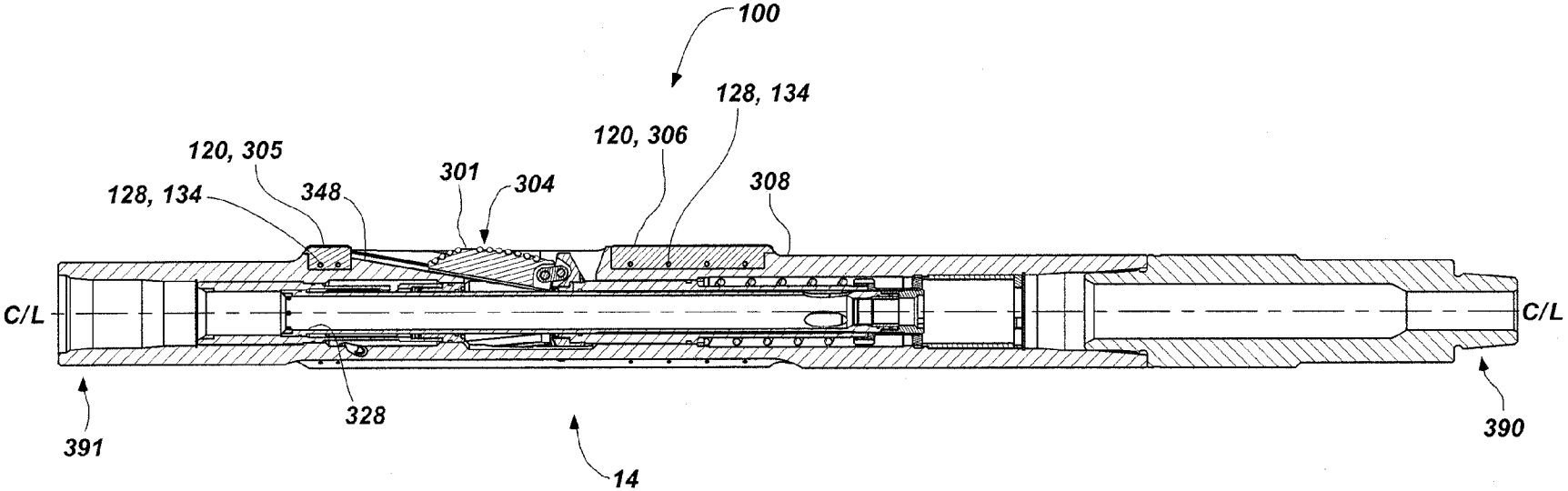

An embodiment of an expandable reaming tool 14 that may be used in the bottom hole assembly 10 of FIG. 1 is illustrated in FIGS. 2, 2A and 2B. The expandable reaming tool 14 may include a generally cylindrical tubular body 308 having a longitudinal axis or centerline C/L (FIG. 2B). The tubular body 308 of the expandable reaming tool 14 may have a lower end 390 and an upper end 391. The terms "lower" and "upper," as used herein with reference to the ends 390, 391, refer to the typical positions of the ends 390, 391 relative to one another when the expandable reaming tool 14 is positioned within a well bore. The lower end 390 of the tubular body 308 of the expandable reaming tool 14 may include a set of threads (e.g., a threaded male pin member) for connecting the lower end 390 to another section or component of the bottom hole assembly 10 (FIG. 1). Similarly, the upper end 391 of the tubular body 308 of the expandable reaming tool 14 may include a set of threads (e.g., a threaded female box member) for connecting the upper end 391 to a section of a drill string or another component of the bottom hole assembly 10 (FIG. 1). In some embodiments, the upper end 391 may connect to or may include a replaceable drill sub for connecting the upper end 391 to a section of a drill string or another component of the bottom hole assembly 10 (FIG. 1).

Three sliding cutter blocks or blades (301 and 302 depicted in FIGS. 2, 301, 302 and 303 depicted in FIG. 2A) are positionally retained in circumferentially spaced relationship in the tubular body 308 as further described below and may be provided at a position along the expandable reaming tool 14 intermediate the first lower end 390 and the second upper end 391. The blades 301, 302, 303 may be comprised of steel, tungsten carbide, a particle-matrix composite material (e.g., hard particles dispersed throughout a metal matrix material), or other suitable materials as known in the art. The blades 301, 302, 303 are movable between a retracted position, in which the blades are retained within the tubular body 308 of the expandable reaming tool 14, and an extended or expanded position in which the blades 301, 302, 303 project laterally from the tubular body 308. The expandable reaming tool 14 may be configured such that the blades 301, 302, 303 engage the walls of a subterranean formation surrounding a well bore in which bottom hole assembly 10 (FIG. 1) is disposed to remove formation material when the blades 301, 302, 303 are in the extended position, but are not operable to so engage the walls of a subterranean formation within a well bore when the blades 301, 302, 303 are in the retracted position. While the expandable reaming tool 14 includes three blades 301, 302, 303, it is contemplated that one, two or more than three blades may be utilized. Moreover, while the blades 301, 302, 303 are symmetrically circumferentially positioned axially along the tubular body 308, the blades 301, 302, 303 may also be positioned circumferentially asymmetrically, and also may be positioned asymmetrically along the longitudinal axis or centerline C/L in the direction of either end 390 and 391.

It is further noted that embodiments of the invention may be implemented using a configuration similar to that described herein with respect to FIGS. 2, 2A and 2B, wherein extendable or expandable stabilizer blades having radially outward facing bearing surfaces are substituted for blades 301, 302, 303, or are employed in conjunction with such blades on the same tool body or on a longitudinally adjacent tool, to provide or enhance stabilization during a reaming operation. As used herein, the term "blade" as applied to components extendable from a downhole tool body does not denote or require any particular configuration, but is merely a term of art. Similarly, the reference to an extended or expanded position of a blade does not denote or require only lateral extension or expansion. In other words, as in the embodiment illustrated in FIGS. 2, 2A and 2B, the blades may extend or expand in an oblique direction, laterally as well as longitudinally with respect to the tool body.

As shown in FIG. 2A, which is a cross-sectional view taken along the section line I-I illustrated in FIG. 2, the tubular body 308 encloses a fluid passageway 392 that extends longitudinally through the tubular body 308. The fluid passageway 392 directs fluid substantially through an inner bore 351 of a traveling sleeve 328.

With continued reference to FIG. 2A, the blades 302 and 303 are shown in the initial or retracted positions, while blade 301 is shown in the outward or extended position. The expandable reaming tool 14 may be configured such that the outermost radial or lateral extent of each of the blades 301, 302, 303 is recessed within the tubular body 308 when in the initial or retracted positions so it may not extend beyond the greatest extent of outer diameter of the tubular body 308. Such an arrangement, which may be appreciated more fully with reference to FIGS. 2 and 2B wherein bearing pads 305, 306 are depicted in relation to a retracted blade 301, is configured to protect the blades 301, 302, 303 as the expandable reaming tool 14 is disposed within a casing of a borehole, and may allow the expandable reaming tool 14 to pass through such casing within a borehole without any potential for damage to blades 301, 302, 303 or cutters 304 thereon. In other embodiments, the outermost radial extent of the blades 301, 302, 303 may coincide with or slightly extend beyond the outer diameter of the tubular body 308. As illustrated by blade 301 in FIG. 2A, the blades extend beyond the outer diameter of the tubular body 308 when in the extended position, to engage the walls of a borehole in a reaming operation.

FIG. 2B is another cross-sectional view of the expandable reaming tool 14 shown in FIGS. 2 and 2A taken along section line II-II shown in FIG. 2A. The tubular body 308 respectively retains three sliding cutter blocks or blades 301, 302, 303 in three blade tracks 348. The blades 301, 302, 303, as noted above, each carry a plurality of cutters 304 for engaging the material of a subterranean formation defining the wall of an open borehole when the blades 301, 302, 303 are in an extended position. The cutters 304 may be polycrystalline diamond compact (PDC) cutters or other cutting elements.

The construction and operation of the expandable reaming tool 14 shown in FIGS. 2, 2A, and 2B is described in further detail, for example, in the previously mentioned U.S. Patent Application Publication No. US 2008/0128175 A1 by Radford et al., which published Jun. 5, 2008.

As depicted in FIGS. 2 and 2B and as mentioned above, expandable reaming tool 14 may comprise stabilizer pads, also referred to herein as bearing pads 305, 306, on the exterior of tubular body 308. The portions of tubular body 308 in combination with each of bearing pads 305, 306 affixed thereto, may be characterized as one embodiment of a stabilizer assembly 100. Bearing pads 305, 306 act to take lateral and rotational loading as expandable reaming tool 14 moves within a well bore with blades 301, 302 and 303 in a retracted or expanded position and reduce vibration during drilling prior to expansion of the blades 301, 302 and 303.

Figure 3:
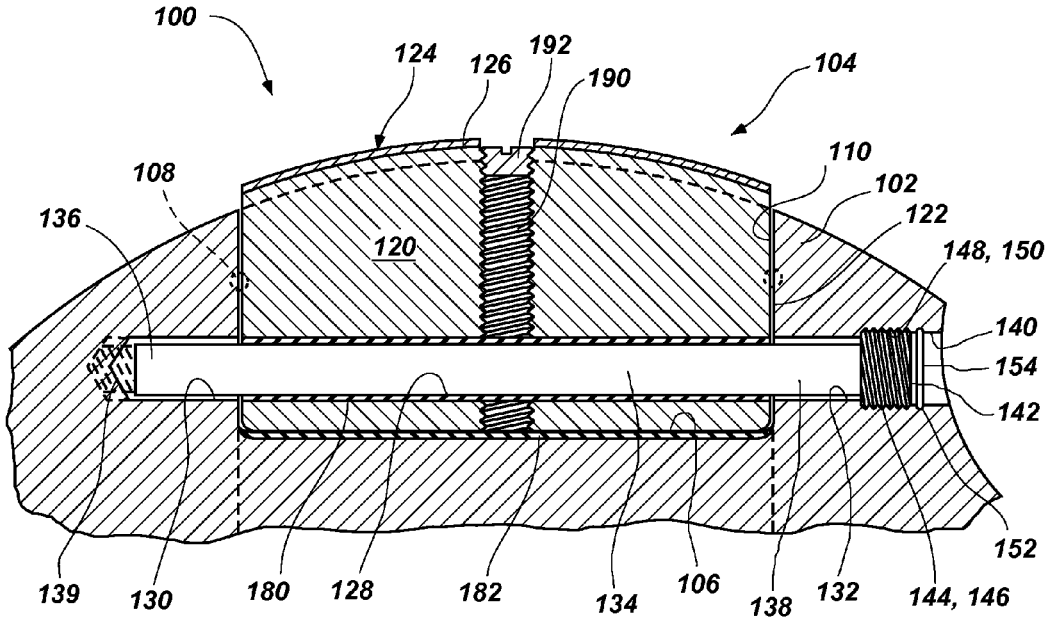
FIG. 3 is a transverse cross-sectional view through a portion of a stabilizer assembly of the expandable reaming tool of FIG. 2.

Referring to FIG. 3, stabilizer assembly 100 comprises a body 102 (which may comprise a portion of tubular body 308 in the case of expandable reaming tool 14) having a bearing pad receptacle 104 formed therein. Bearing pad receptacle 104 may comprise a partially closed cavity having a floor 106, or may comprise an open cavity extending to an interior bore of the body 102, as depicted in broken lines. If the latter, a seal element 108 may be disposed, as shown in broken lines, between a sidewall 110 of bearing pad receptacle 104 and a sidewall 122 of bearing pad 120 disposed in bearing pad receptacle 104. Seal element 108 may comprise, for example, an elastomeric material compressed between sidewall 110 of bearing pad receptacle 104 and sidewall 122 of bearing pad 120.

Bearing pad 120 may be, for example, of a rectangular elevational configuration as depicted, although other configurations (square, circular, ovoid, rectangular with one or more arcuate ends, dog bone, etc.) are encompassed by the present invention. Bearing pad receptacle 104 is of substantially the same configuration as that of bearing pad 120, but slightly larger to facilitate receiving bearing pad 120 therein. The radially exterior surface 124 of bearing pad 120 may be arcuate and, optionally, of circumferential curvature slightly smaller than, but substantially conforming to, the curvature of a well bore wall against which radially exterior surface 124 will ride during drilling, reaming or other downhole operations. As depicted schematically at 126, radially exterior surface 124 may comprise one or more of metallic hardfacing, tungsten carbide inserts, diamond or other superabrasive material, or other wear elements.

As depicted, bearing pad 120 may have a plurality of transverse bores 128 (see FIG. 2B) extending therethrough between laterally opposing sidewalls 122. Each transverse bore 128 is, when bearing pad 120 is received in bearing pad receptacle 104 in its desired position, aligned with a blind bore 130 extending into a lateral sidewall 110 on one side of bearing pad receptacle 104, and with an open bore 132 extending into a lateral sidewall 110 on an opposing side of bearing pad receptacle 104. A lock rod 134 is inserted through each open bore 132, through an aligned transverse bore 128 and into an aligned blind bore 130 so that a distal end 136 of lock rod 134 is received within the aligned blind bore 130. A proximal end 138 of each lock rod 134 resides completely within open bore 132 when lock rod 134 is fully inserted into blind bore 130. Optionally, a biasing structure 139 may be disposed within blind bore 130 outboard of the proximal end 138 of a lock rod 134 disposed therein. Full disposition of proximal end 138 may compress biasing structure 139, shown in broken lines in an extension of blind bore 130 also shown in broken lines, thus facilitating removal of lock rod 134 when desired or required. Biasing structure 139 may comprise, for example, a coil spring, a Belleville spring, or a resilient elastomeric element.

Figure 4:
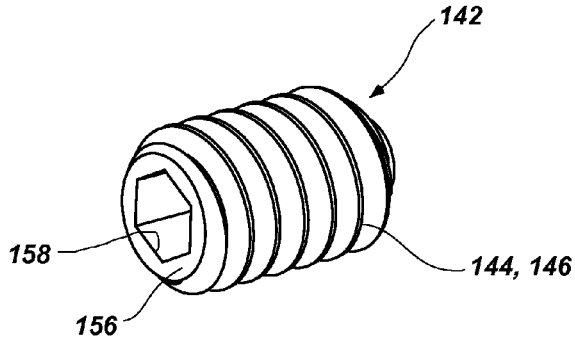
FIG. 4 is a perspective view of a threaded plug suitable for use in an embodiment of the invention.

Outer end, which may also be characterized as a "mouth" 140 of each open bore 132 is configured to receive a removable closure outwardly of proximal end 138 of lock rod 134 to prevent the lock rod 134 from backing out during operation of the stabilizer assembly 100. As depicted, the removable closure may comprise a plug in the form of set screw 142, which may also be characterized as a plug, having male threads 144 on a laterally outer surface 146 thereof, male threads 144 configured for engagement with female threads 148 residing on the inner wall 150 of open bore 132 proximate the mouth 140 thereof. One suitable plug configuration is depicted in FIG. 4. The threads 144, 148 may comprise straight or tapered threads. If the inner wall 150 comprises an annular groove 152 therein, a retaining ring 154, such as a compressible snap ring, may be disposed partially therein and extend radially inwardly of an outer diameter of set screw 142 to prevent set screw 142 from backing out of open bore 132. Outer face 156 of set screw 142 may comprise a tool engagement structure such as a receptacle 158 (FIG. 4) configured as a slot for engagement with a screwdriver blade, or a cavity configured for engagement with an Allen wrench or a TORX® wrench, by which set screw 142 may be rotated for insertion into and removal from open bore 132.

Referring again to FIG. 3, additional structure may be employed with stabilizer assembly 100 in order to dampen vibrations, and hence lessen fatigue, due to rotation of stabilizer assembly 100 and the associated periodic radial and tangential contact of bearing pad 120 with a well bore wall. Specifically, a resilient sleeve 180 may be placed around lock rods 134 to minimize, and dampen, movement of bearing pad 120 in a lateral (radial) direction. Resilient sleeve 180 may be, in one embodiment, of a suitable elastomer which may be shrink-fit, using, for example, application of heat from a heat gun, onto the shaft of a lock rod 134. Additionally, or alternatively, a resilient pad 182 may be placed, and optionally adhered, to the floor 106 of bearing pad receptacle 104 and slightly compressed by insertion of bearing pad 120 into bearing pad receptacle 104 and subsequent insertion of lock rods 134 to maintain the compression of resilient pad 182 against floor 106. Resilient pad 182 may also comprise an elastomer, such as a natural or synthetic rubber or other polymer. The term "resilient," as used herein, is expansive and not limiting and, therefore, is not limited to any particular natural or synthetic material, but encompasses elastically deformable, compressible materials of any type suited for the environment to which the tool may be exposed in operation. For example, in its most expansive sense, the term resilient contemplates materials, including metals and alloys, which are softer and more resilient than steel. Suitable examples of such materials include, without limitation, brass, copper and aluminum. Therefore, resilient sleeve 180 and resilient pad 182, the latter of which may also be characterized as a "shim," may each comprise a metal or alloy, or one may comprise an elastomer, without limitation.

Referring yet again to FIG. 3, bearing pad 120 may further be, optionally, configured with one or more, longitudinally spaced, threaded apertures 190, one of which is shown extending behind (as the drawing figure is viewed) lock rod 134 in an aligned transverse bore, although in practice there would be material of the bearing pad 120 between any aperture 190 and any transverse bore 128. The threaded apertures 190 are, thus, longitudinally located at positions offset from transverse bores 128. Apertures 190 may be closed with threaded plugs 192 at their outer ends to accommodate normal drilling and reaming operations to prevent clogging with debris. The plugs 192 would then be removed for insertion of jack screws to be threaded into apertures 190 to press against floor 106 of bearing pad receptacle 120 (or against elastomeric pad 182, if employed), to lift bearing pad 120 out of bearing pad receptacle 104. Alternatively, jack screws (not shown) may be pre-placed in apertures 190 in installed bearing pad 120, and rotated to lift bearing pad 120 from bearing pad receptacle 104 as desired or required. The jack screws may have screwdriver slots, hex receptacles for receipt of an Allen wrench, or a TORX® wrench receptacle at their respective, outer ends.

In another embodiment (not shown), body 102 may comprise open bores 132 on laterally opposing sides of bearing pad receptacle 104, and a set screw 142 secured in each open bore 132 outboard of a lock rod 134 extending therebetween and through an aligned transverse bore 128 of a bearing pad 120. In some embodiments, an open bore 132 on one of the lateral sides of bearing pad receptacle 104 may include a smaller opening than the open bore 132 on the opposing lateral side of the bearing pad receptacle 104. Such an embodiment may not include a set screw in the open bore 132 including the smaller opening, but rather, the smaller opening may allow a tool to be inserted within the smaller opening to displace the lock rod 134 toward the opposing open bore 132 for removal of the lock rod 134.

Figure 5A:
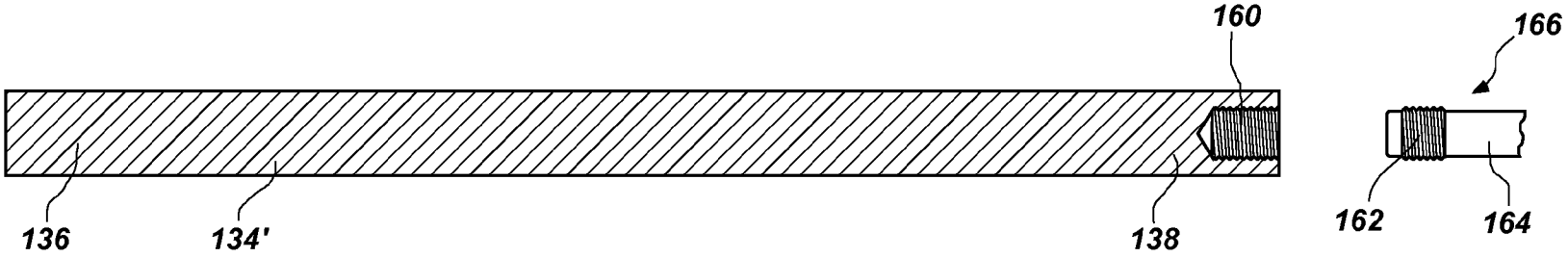
FIG. 5A is a side, partial cross-sectional elevational view of an embodiment of a lock rod having an extraction structure at one end thereof.

FIG. 5A depicts an embodiment of a lock rod 134' for use in the invention. Lock rod 134' comprises a distal end 136, and a proximal end 138 having an extraction structure in the form of an axially extending, threaded bore 160 extending thereinto and having threads configured for engagement with male threaded distal end 162 of shaft 164 of extraction tool 166. With such an arrangement, a lock rod 134' inserted through an open bore 132, through a transverse bore 128 and into a blind bore 130 so that proximal end 138 of the lock rod 134' is substantially within open bore 132 (FIG. 3) and, so, at least difficult to reach if not jammed in place by well bore particulates or other debris, may be engaged with extraction tool 166. Shaft 164 is inserted into open bore 132 and male threaded distal end 162 engaged with threaded bore 160 at proximal end 138 of lock rod 134' by rotation of extraction tool 166 by a handle (not shown). Lock rod 134' may then be pulled out of body 102.

Figure 5B:
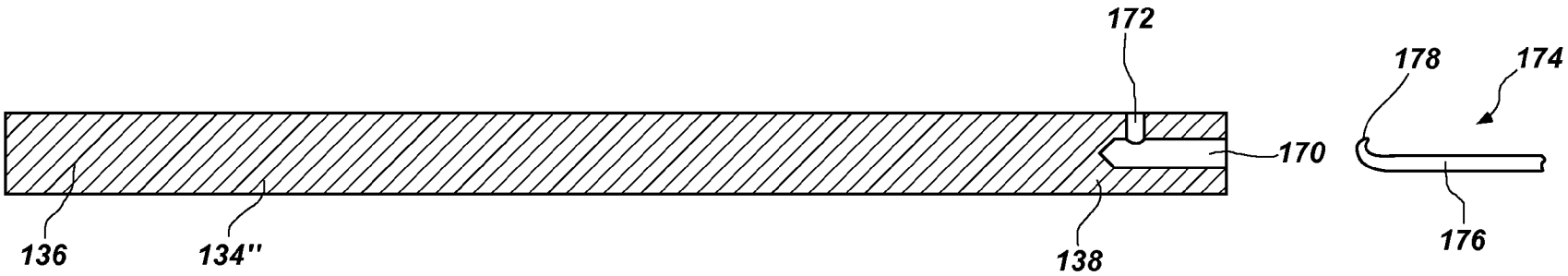
FIG. 5B is a side, partial cross-sectional elevational view of another embodiment of a lock rod having an extraction structure at one end thereof.

FIG. 5B depicts another embodiment of a lock rod 134" for use in the invention. Lock rod 134" comprises a distal end 136, and a proximal end 138 having an extraction structure in the form of an axially extending bore 170 extending thereinto and another, substantially transverse bore 172 intersecting axially extending bore 170. With such an arrangement, a lock rod 134" inserted through an open bore 132, through a transverse bore 128 and into a blind bore 130 (FIG. 3) so that proximal end 138 of the lock rod 134" is substantially within open bore 132 and, so, at least difficult to reach if not jammed in place by well bore particulates or other debris, may be engaged with extraction tool 174 comprising a shaft 176 with a hook 178 at a distal end thereof. Shaft 176 is inserted into open bore 132 and hook 178 inserted into axially extending bore 170 at proximal end 138 of lock rod 134" and engaged with transverse bore 172 by manipulation of a handle (not shown). Lock rod 134" may then be pulled out of body 102.

Figure 6A:
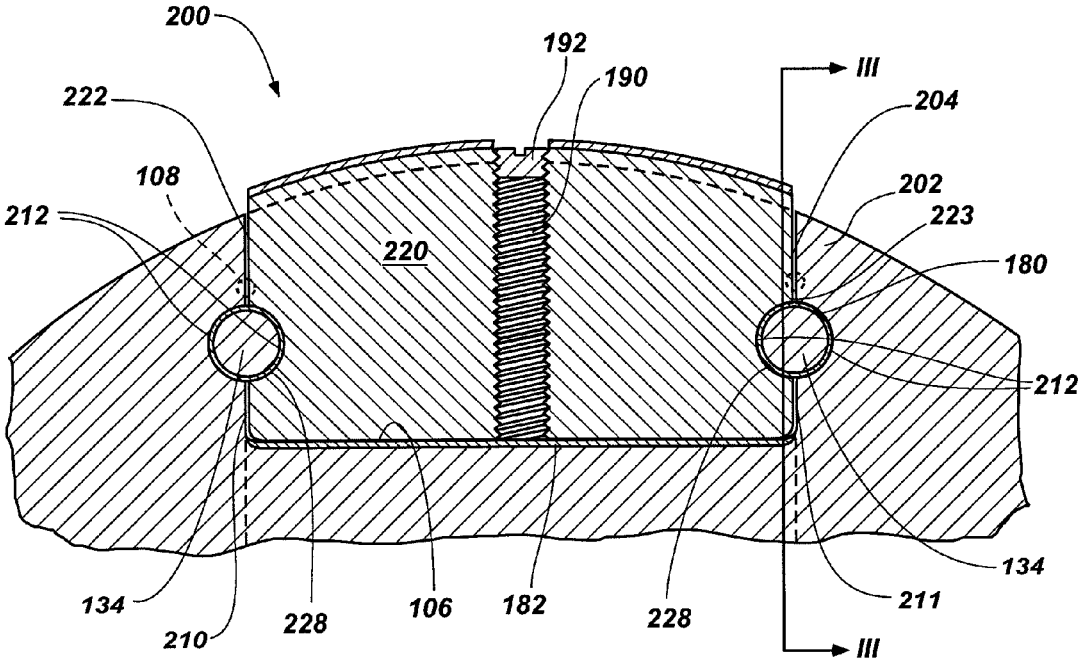
FIG. 6A is a cross-sectional view through a portion of a stabilizer assembly in accordance with yet another embodiment of the present invention.
Figure 6B:
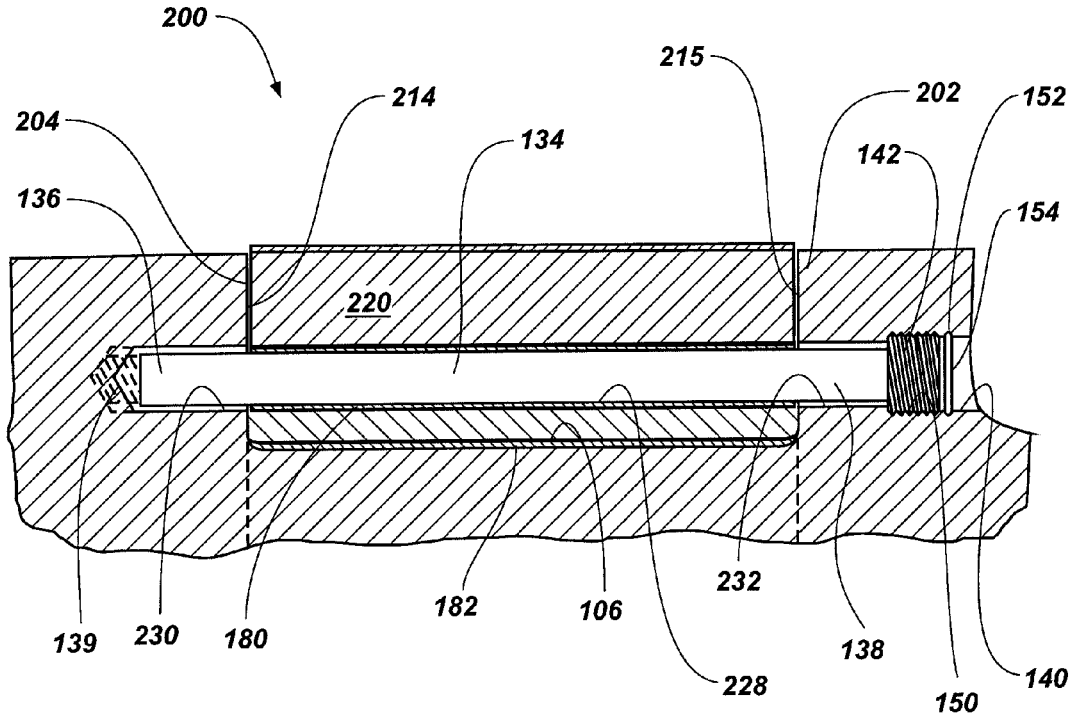
FIG. 6B is a transverse cross-sectional view through the portion of the stabilizer assembly shown in FIG. 6A.

FIGS. 6A and 6B show cross-sectional views through a portion of a stabilizer assembly in accordance with yet another embodiment of the present invention. As shown in FIG. 6A, a stabilizer assembly 200 may be substantially similar to the stabilizer assembly 100 shown and described with reference to FIGS. 2 and 3 and may comprise a body 202 (e.g., a portion of tubular body 308 in the case of expandable reaming tool 14 as shown in FIG. 2) having a bearing pad receptacle 204 formed therein. The bearing pad receptacle 204 may comprise a partially closed cavity having a floor 106, or may comprise an open cavity extending to an interior bore of the body 202, as depicted in broken lines, including a seal element 108 extending around the bearing pad 220. The bearing pad receptacle 204 may include a lateral sidewall 210 and an opposing lateral sidewall 211.

The bearing pad 220 may be substantially similar to the bearing pad 120 shown and described with reference to FIGS. 2 and 3 and may include a lateral sidewall 222 and an opposing lateral sidewall 223. The bearing pad 220 may have a plurality of bores (i.e., bores similar to the bore 128 described above with reference to FIG. 3) extending longitudinally therethrough. In some embodiments, the bearing pad 220 may have only a cross-sectional portion of the bore extending therethrough. For example, as shown in FIG. 6A, grooves 212 may extend longitudinally along the lateral sidewalls 210, 211 of the bearing pad receptacle 204 and longitudinally along the lateral sidewalls 222, 223 of the bearing pad 220. The longitudinally extending grooves 212 in the bearing pad 220 and the bearing pad receptacle 204 may, in combination, form a plurality of longitudinal bores 228 extending through the bearing pad 220 and the bearing pad receptacle 204. Referring now to FIG. 6B, which is a cross-sectional view taken along section line III-III illustrated in FIG. 6A, each longitudinal bore 228 is, when bearing pad 220 is received in bearing pad receptacle 204 in its desired position, aligned with a blind bore 230 extending into a longitudinal sidewall 214 on one side of the bearing pad receptacle 204, and with an open bore 232 (e.g., a through bore) extending into a longitudinal sidewall 215 on an opposing side of the bearing pad receptacle 204.

Referring again to FIGS. 6A and 6B, a lock rod 134 is inserted through each open bore 232, through an aligned longitudinal bore 228 and into an aligned blind bore 230 so that a distal end 136 of lock rod 134 is received within the aligned blind bore 230. A proximal end 138 of each lock rod 134 resides completely within open bore 232 when lock rod 134 is fully inserted into blind bore 230. Insertion of the lock rod 134 into the longitudinal bore 228 and adjoining blind bore 230 and open bore 232 will retain the bearing pad 220 in the bearing pad receptacle 204. In embodiments where the lock rod 134 is received in a longitudinal bore 228 formed by grooves 212 in the bearing pad 220 and the bearing pad receptacle 204, the lock rod 134 is inserted between the grooves 212 to retain the bearing pad 220 in the bearing pad receptacle 204. As shown in FIG. 6B, in some embodiments, the lock rod 134 may extend from the open bore 232 to the adjacent longitudinal bore 228 formed by the grooves 212 in the bearing pad 220 and the bearing pad receptacle 204. The lock rod 134 may further extend from the longitudinal bore 228 to the adjacent blind bore 230. It is noted that while the embodiment of FIG. 6A illustrates grooves 212 extending longitudinally along the bearing pad receptacle 204 of the stabilizer assembly 200, grooves may also extend laterally along an end of a bearing pad and an adjacent end wall of a bearing pad receptacle (e.g., the bearing pad 120 and the bearing pad receptacle 104 described above with reference to FIG. 3) to retain the bearing pad with laterally extended lock rods.

Similar to the stabilizer assembly 100 described above with reference to FIG. 3, the stabilizer assembly 200 may include a biasing structure 139 disposed within the blind bore 230 outboard of the proximal end 138 of a lock rod 134 disposed therein. Full disposition of proximal end 138 of the lock rod 134 may compress biasing structure 139, shown in broken lines in an extension of blind bore 230 also shown in broken lines, thus facilitating removal of the lock rod 134 when desired or required.

The stabilizer assembly 200 may also include a mouth 140 of each open bore 232. As described above with reference to FIG. 3, the mouth 140 is configured to receive a removable closure (e.g., the set screw 142) outwardly of the proximal end 138 of the lock rod 134 to prevent the lock rod 134 from backing out during operation of the stabilizer assembly 200. An inner wall 150 of the mouth 140 may include an annular groove 152 therein and a retaining ring 154 (e.g., a compressible snap ring) disposed partially therein to prevent the set screw 142 from backing out of the open bore 232.

In some embodiments, the body 202 may comprise open bores 232 on longitudinally opposing sides of bearing pad receptacle 204 (i.e., the blind bore 230 is replaced with another open bore 232). A set screw 142 may be secured in each open bore 232 to retain the lock rod 134 extending therebetween and through an aligned longitudinal bore 228. In some embodiments, an open bore 232 on one of the longitudinal sides of bearing pad receptacle 204 may include a smaller opening than the open bore 232 on the opposing longitudinal side of the bearing pad receptacle 204. Such an embodiment may not include a set screw in the open bore 232 including the smaller opening, but rather, the smaller opening may allow a tool to be inserted within the smaller opening to displace the lock rod 134 toward the opposing open bore 232 for removal of the lock rod 134.

Referring again to FIGS. 6A and 6B, additional structure may be employed with stabilizer assembly 200 in order to dampen vibrations, and hence lessen fatigue, due to rotation of stabilizer assembly 200 and the associated periodic radial and tangential contact of bearing pad 220 with a well bore wall. Similar to the stabilizer assembly 100 shown and described with reference to FIG. 3, the stabilizer assembly 200 may include a resilient sleeve 180 placed around lock rods 134 to minimize, and dampen, movement of bearing pad 220. Additionally, or alternatively, a resilient pad 182 may be placed, and optionally adhered, to the floor 106 of bearing pad receptacle 204 and slightly compressed by insertion of bearing pad 220 into bearing pad receptacle 204 and subsequent insertion of lock rods 134 to maintain the compression of resilient pad 182 against floor 106.

In some embodiments, the stabilizer assembly 200 may also include threaded apertures 190 closed with threaded plugs 192 that may be removed for insertion of jack screws to be threaded into apertures 190 to press against floor 106 of bearing pad receptacle 204 (or against elastomeric pad 182, if employed), to lift bearing pad 220 out of bearing pad receptacle 204.

The lock rods 134 described herein may comprise materials such as, for example metal or alloy material (e.g., a steel, aluminum alloy, cast iron, etc.). In some embodiments, the lock rods 134 may comprise a high strength hardened alloy steel such as, for example, AERMET® 100 Alloy available from Carpenter Technology Corp. of Reading, Pa. When a metal is employed in the lock rods 134, the lock rods 134 may be polished to remove surface imperfections in the metal and to improve the ability of the lock rods 134 to be installed and removed from the bores 128, 228 of the stabilizer assembly 100, 200.

Figure 7:
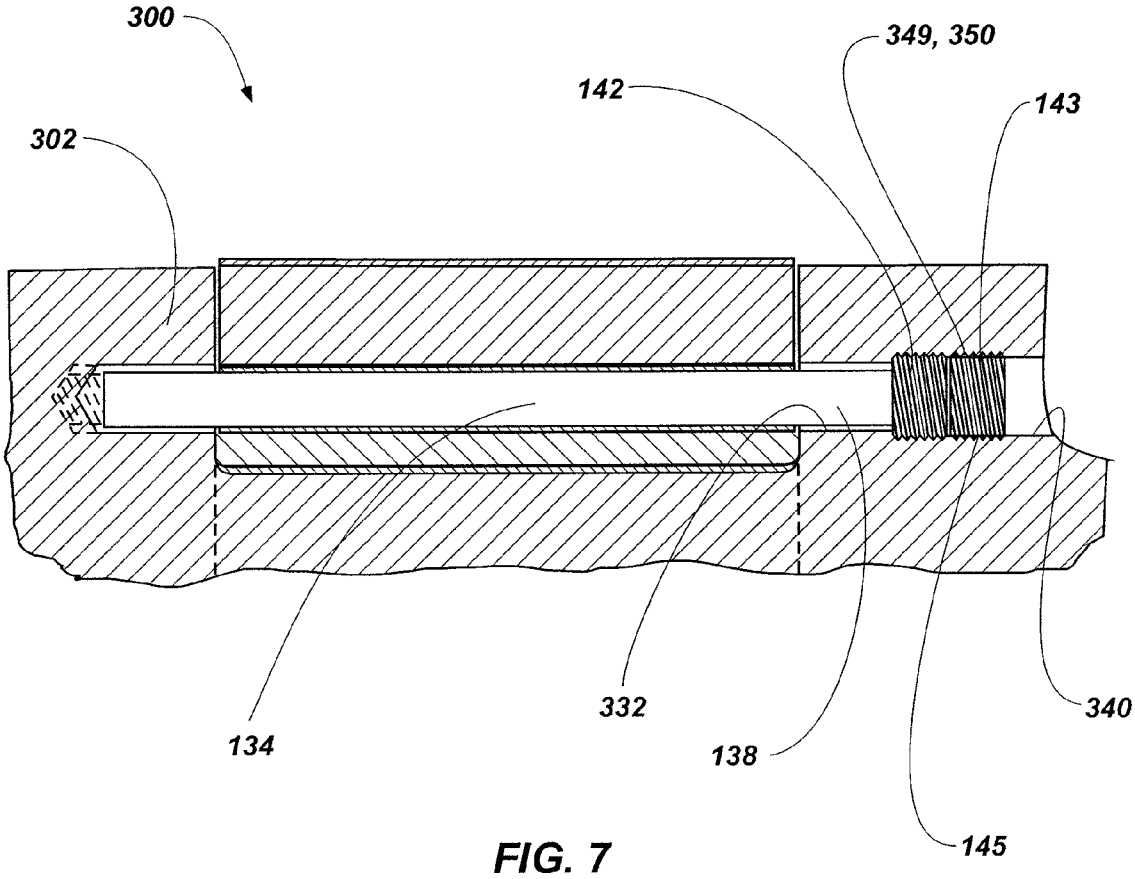
FIG. 7 is a transverse cross-sectional view through a portion of a stabilizer assembly in accordance with yet another embodiment of the present invention.

FIG. 7 is a transverse cross-sectional view through a portion of a stabilizer assembly in accordance with yet another embodiment of the present invention. As shown in FIG. 7, a stabilizer assembly (e.g., stabilizer assembly 300) may include a body 302 having a mouth 340 of an open bore (e.g., the open bore 332). The mouth 340 may be configured to receive a removable closure outwardly of proximal end 138 of lock rod 134 to prevent the lock rod 134 from backing out during operation of the stabilizer assembly 300. For example, as described above with reference to FIGS. 3 and 6B, the removable closure may comprise a set screw 142. In some embodiments, the removable closure may include an additional plug (e.g., a jam screw 143) that may be substantially similar to the set screw 142 shown and described with reference to FIG. 4. Referring still to FIG. 7, the mouth 340 may be configured to receive the jam screw 143 outboard of the set screw 142. For example, the mouth 340 may contain additional female threads 349 residing on an inner wall 350 of the open bore 332 proximate the mouth 340 configured for engagement with male threads 145 of the jam screw 143. The jam screw 143 may be disposed outboard of the set screw 142 and may abut the set screw 142 to prevent the set screw 142 from backing out of the open bore 332. It is noted that while the embodiment of FIG. 7 illustrates the jam screw 143 disposed in the open bore 332 of the stabilizer assembly 300, the jam screw 143 may be utilized in other configurations (e.g., the open bore 132 of the stabilizer assembly 100 shown in FIG. 3, the open bore 232 of the stabilizer assembly 200 shown in FIG. 6B, etc.). It is further noted that while the embodiment of FIG. 7 illustrates the jam screw 143 having a diameter similar to the diameter of the set screw 142, the diameter of the jam screw 143 may be greater than the diameter of the set screw 142. Further, in some embodiments, the jam screw 143 may comprise a different material than the set screw 142. In additional embodiments, the jam screw 143 may exhibit a differing thread profile than the set screw 142 in order to retain the set screw 142 in the open bore 132.

While the invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed, including legal equivalents thereof. In addition, features from one embodiment may be combined with features of another embodiment while still being encompassed within the scope of the invention as contemplated by the inventors.

What is claimed is:

1. A stabilizer assembly, comprising:

a body having at least one longitudinally extending bearing pad receptacle therein and at least two lateral body grooves formed in opposing sidewalls of the at least one longitudinally extending bearing pad receptacle;

a bearing pad disposed in the at least one longitudinally extending bearing pad receptacle, the bearing pad including at least two lateral pad grooves formed in opposing sidewalls thereof complementary to the at least two lateral body grooves and wherein the at least two lateral body grooves and the at least two lateral pad grooves form at least two lateral bores, each bore being formed by one of the at least two lateral pad grooves and one of the at least two lateral body grooves;

a plurality of body bores on opposite sides of the at least one longitudinally extending bearing pad receptacle, each body bore aligned with a body bore on an opposite side of the at least one longitudinally extending bearing pad receptacle and at least partially aligned with one of the at least two lateral bores; and at least two lock rods, wherein each lock rod of the at least two lock rods extends through one bore of the at least two lateral bores and into each body bore aligned therewith.

2. The stabilizer assembly of claim 1, wherein each lock rod of the at least two lock rods comprises a hardened and polished alloy steel material.

3. The stabilizer assembly of claim 1, wherein:

at least two body bores of the plurality of body bores on one side of the at least one longitudinally extending bearing pad receptacle each comprise a blind bore; and at least two body bores of the plurality of body bores on an opposite side of the at least one longitudinally extending bearing pad receptacle each comprise a through bore extending therefrom to an exterior surface of the body.

4. The stabilizer assembly of claim 3, further comprising a removable closure received in each through bore outboard of an end of the lock rod.

5. The stabilizer assembly of claim 4, wherein the removable closure comprises a set screw and a jam screw abutting the set screw.

6. A stabilizer assembly, comprising:

a body having at least one longitudinally extending bearing pad receptacle therein;

a plurality of longitudinally extending body bores formed on each longitudinal side of the at least one longitudinally extending bearing pad receptacle, wherein at least two longitudinally extending body bores of the plurality of longitudinally extending body bores on one longitudinal side of the at least one longitudinally extending bearing pad receptacle each comprise a blind bore; and at least two longitudinally extending body bores of the plurality of longitudinally extending body bores on a longitudinally opposite side of the at least one longitudinally extending bearing pad receptacle each comprise a through bore extending therefrom to an exterior surface of the body;

a bearing pad disposed in the at least one longitudinally extending bearing pad receptacle;

at least two longitudinally extending bores formed in at least one of a portion of the bearing pad and a portion of the at least one longitudinally extending bearing pad receptacle, each bore longitudinally aligned with at least two longitudinally extending body bores of the plurality of longitudinally extending body bores;

a lock rod extending through each of the at least two longitudinally extending bores and into at least one longitudinally extending body bore of the plurality of longitudinally extending body bores aligned therewith;

a removable closure received in each through bore outboard of an end of the lock rod;

an annular groove in each through bore outboard of the removable closure; and a retaining ring extending into the annular groove and radially inwardly of an outer diameter of the removable closure.

7. The stabilizer assembly of claim 6, wherein the at least two longitudinally extending bores are formed by a plurality of longitudinally extending grooves, the plurality of longitudinally extending grooves being formed in a portion of the bearing pad and a portion of the at least one longitudinally extending bearing pad receptacle.

8. The stabilizer assembly of claim 6, wherein the removable closure comprises:

a set screw having male threads on an exterior surface thereof engaged with female threads on a wall of the through bore; and a jam screw having male threads on an exterior surface thereof engaged with female threads on a wall of the through bore and abutting at least a portion of the set screw.

9. The stabilizer assembly of claim 6, further comprising a biasing structure disposed within each blind bore outboard of an end of the lock rod.

10. The stabilizer assembly of claim 6, wherein a longitudinal end of the lock rod in the through bore comprises an extraction structure configured for engagement with an extraction tool.

11. The stabilizer assembly of claim 10, wherein the extraction structure comprises an axially extending threaded bore extending into the longitudinal end of the lock rod.

12. The stabilizer assembly of claim 6, further comprising at least one of a resilient pad disposed between the bearing pad and a floor of the at least one longitudinally extending bearing pad receptacle and a resilient sleeve disposed about the lock rod within each of the at least two longitudinally extending bores.

13. The stabilizer assembly of claim 6, wherein the bearing pad includes at least one longitudinally spaced threaded aperture therein extending laterally from a radially outer bearing surface of the bearing pad to a floor of the at least one longitudinally extending bearing pad receptacle.

14. A stabilizer assembly, comprising:

a body having at least one longitudinally extending bearing pad receptacle therein;

a plurality of longitudinally extending body bores formed on each longitudinal side of the at least one longitudinally extending bearing pad receptacle, wherein at least two longitudinally extending body bores of the plurality of longitudinally extending body bores on one longitudinal side of the at least one longitudinally extending bearing pad receptacle each comprise a blind bore; and at least two longitudinally extending body bores of the plurality of longitudinally extending body bores on a longitudinally opposite side of the at least one longitudinally extending bearing pad receptacle each comprise a through bore extending therefrom to an exterior surface of the body;

a bearing pad disposed in the at least one longitudinally extending bearing pad receptacle;

at least two longitudinally extending bores formed in at least one of a portion of the bearing pad and a portion of the at least one longitudinally extending bearing pad receptacle, each bore longitudinally aligned with at least two longitudinally extending body bores of the plurality of longitudinally extending body bores; and a lock rod extending through each of the at least two longitudinally extending bores and into at least one longitudinally extending body bore of the plurality of longitudinally extending body bores aligned therewith, wherein a longitudinal end of the lock rod in the through bore comprises an extraction structure configured for engagement with an extraction tool, wherein the extraction structure comprises an axial bore extending into the longitudinal end of the lock rod intersected by another, substantially transverse bore.

* * * * *